United States Patent [19]

Sterner, Jr.

[11] Patent Number: 4,570,381

[45] Date of Patent: Feb. 18, 1986

[54] SINGLE PLANE WINDOW OR DOOR STRUCTURE

[75] Inventor: Maurice E. Sterner, Jr., Spring Grove, Pa.

[73] Assignee: Product Design & Development, Inc., York, Pa.

[21] Appl. No.: 601,955

[22] Filed: Apr. 19, 1984

[51] Int. Cl.[3] ..... E05D 15/20

[52] U.S. Cl. ..... 49/129; 49/130

[58] Field of Search ..... 49/128, 129, 130, 127

[56] References Cited

U.S. PATENT DOCUMENTS

Re. 31,721 11/1984 Sterner, Jr. ..... 49/130 X 2,317,312 4/1943 Swanson et al. ..... 49/130

FOREIGN PATENT DOCUMENTS 439664 12/1967 Switzerland ..... 49/130

*Primary Examiner*—Kenneth Downey

*Attorney, Agent, or Firm*—O'Neil & Bean

[57] ABSTRACT

An insulated single plane window or door assembly including a casing defining a generally rectangular opening in a building wall and having first and second pairs of spaced parallel tracks with each pair being adapted to support a glazing frame with the glazing frames normally disposed for sliding movement in parallel laterally spaced vertical planes and for pivotal movement to incline the glazing frames from their respective vertical planes, with one pair of tracks being adapted to displace the glazing frame supported therein laterally into the vertical plane of and into substantially edge-to-edge relation with the other glazing frame to close the door or window assembly. The casement includes a mullion extending transversely of the rectangular opening adjacent to the juxtaposed edges of the two glazing frames when in the closed position and a resilient seal is provided between the mullion and an external surface of the respective glazing frames. A manually actuated lock carried by one of the glazing frames is adapted to cooperate with the mullion to lock the glazing frames in the closed coplanar relationship and in engagement with the resilient seals to provide a secure, weather-tight closure.

13 Claims, 10 Drawing Figures

FIG. 1
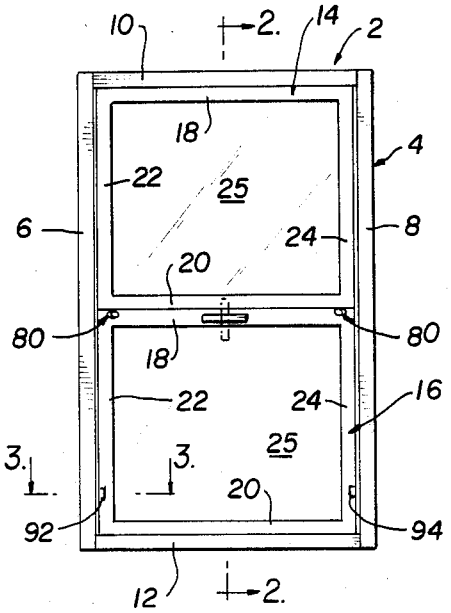
FIG. 2
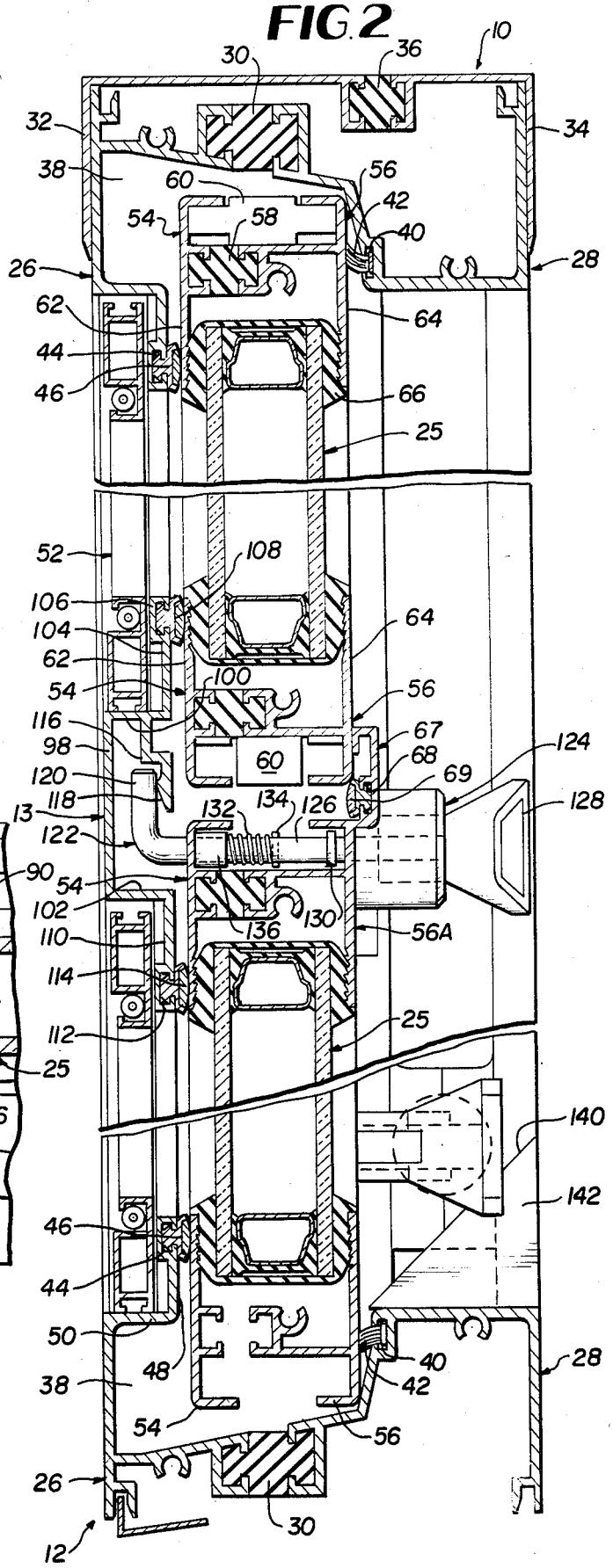
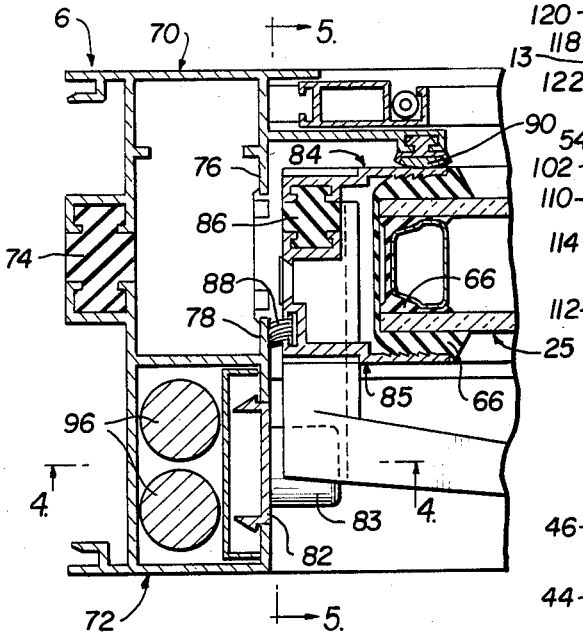
FIG. 3

SINGLE PLANE WINDOW OR DOOR STRUCTURE

BACKGROUND OF THE INVENTION

1. Field of the Invention

This invention relates to door and window assemblies for use in building structures, and more particularly to an improved door or window assembly of the type having a plurality of glazing frames disposed in a common plane in the closed condition and adapted to be supported in laterally spaced planes in the open condition.

2. Description of the Prior Art

Sliding glazing frames used as windows and doors are well known and commonly used in buildings, particularly for residences and for small business and industrial buildings. Windows used in such structures, for example, comprise a pair of such sliding glazing frames, or sashes, each of which is movable usually in a vertical direction, to open and close the window. structure to provide ventilation and the like. Each sash is mounted for movement along a separate pair of tracks or guide channels, with the two pair of tracks being in closely spaced parallel relation so that in the open condition, the two sashes are in overlapping juxtaposed relation and in the closed position, the two sashes cooperate to completely close the building opening.

Windows employing a plurality of sliding sashes supported for movement in a horizontal direction are also known, with the structure and operation being substantially the same as that just described. Sliding doors such as patio doors and closet doors are also known in which two door panels are movable in spaced parallel tracks so that the door may be opened at either side or partially opened from both sides if desired. Again, each door panel is supported for movement by a separate track.

Sliding door and window structures are also known which employ two sliding panels, whether doors or window sashes, wherein the two sliding panels move in spaced parallel relation relative to one another in the opened condition and are disposed in coplanar, edge-to-edge sealing relation when in the completely closed condition.

U.S. Pat. No. 4,384,429 discloses a rollaway patio door structure including one fixed panel and one movable panel, the movable panel in the closed position being substantially coplanar with the fixed panel and in the opened position being parallel with and spaced inwardly from the fixed panel. The movable panel is supported for inward and outward lateral movement by a cam structure which in turn is movable along a track parallel to the fixed door panel to open and close the door.

U.S. Pat. No. 2,680,268 discloses a door structure including two movable door panels which are disposed in edge-to-edge, coplanar relation in the closed condition and either of which may be moved laterally into a parallel plane then moved in its parallel plane relative to the other door. Such structure is intended primarily for internal doors such as closets or the like, however, and no means for sealing the doors is disclosed.

U.S. Pat. No. 4,324,072 discloses a multiple panel structure suitable for use either as a door or window. The structure employs two panels disposed in edge-to-edge coplanar relation in the closed position and includes means supporting one of the panels for movement into a laterally spaced parallel plane to permit either panel to be slid along its supporting track to open the structure from the top and/or bottom in case of a vertical moving window, or from either side in the case of a horizontally moving window or door structure. The two panels are also supported for pivotal movement, upon release of a latching mechanism, to permit the respective panels to be pivoted inwardly from the frame structure. This pivotal action is particularly important in windows since it permits easy access to both sides of the panel for cleaning or the like.

Numerous other structures, principally windows, are known wherein two sliding panels move in spaced parallel relation along a supporting track structure in the frame in the opened condition and in which the sliding panels move into edge-to-edge coplanar relation (in line) in the closed position. Many of these prior window structures are listed, for example, as referehces in said U.S. Pat. No. 4,324,072. These prior art structures generally have been supported in a rectangular frame having a single rectangular opening, with cooperating locking or latching mechanisms being provided on the adjacent edge frame members of the door or window panels for securing the panels in the closed position. Such structures present difficulties however particularly in providing a weather-tight seal and in providing satisfactory thermal insulation, as well as in providing adequate security against intrusion. Accordingly, it is a primary object of the present invention to provide an improved door or window structure including two sliding panel members disposed in coplanar, or in line relation in the closed condition and in spaced parallel sliding relation for opening the door or window installation.

Another object is to provide such an installation having enhanced structural strength and stability and providing added security against intrusion.

Another object is to provide such a door or window structure which enables a more positive weather-tight seal and having excellent thermal insulation features.

More specifically, it is an object of the present invention to provide an improvement window or door structure of the type disclosed in U.S. Pat. No. 4,324,072, the entire disclosure of which is incorporated herein by reference.

SUMMARY OF THE INVENTION

The foregoing and other objects and advantages of the present invention are achieved in a door or window structure including a generally rectangular frame adapted to be mounted in an opening in an outer wall of a building and including inner and outer parallel pairs of closure panel guide tracks in opposed frame members with each set of tracks supporting a closure panel for sliding movement in parallel adjacent planes to open the window, with one closure panel being support in its track by a movable guide block which engages a laterally projecting channel rigidly mounted on the panel frame to permit the panel to be moved into coplanar relation with the other panel in the closed position. A mullion extends between the pair of frame members having the guide tracks therein, with the mullion being positioned on the outside of the building opening adjacent the common plane and overlapping the adjacent edges of the closure panels in the closed position. The mullion thus reinforces the frame as well as the juxtaposed frame members of the closure panels in the closed condition and carries sealing means providing a weather-tight seal with each of the adjacent frame members of each panel in the closed position. Security latching means carried by the laterally movable closure panel is adapted to engage the rigid fixed mullion to firmly lock both closure panels, thereby providing added security against unwanted intrusion from the exterior. By providing the seal means between the mullion and each of the two closure panels, clearance between the adjacent edge portions of the closure panels is less critical. A secondary seal member carried on one of the closure panels and engaging the other in the closed condition provides an effective second seal providing improved weather-tightness and thermal barrier characteristics of the structure.

BRIEF DESCRIPTION OF THE DRAWINGS

Other features and advantages of the invention will be apparent from the detailed description contained hereinbelow, taken in conjunction with the drawings, in which:

FIG. 1 is an elevation view, from the interior of a building, of a window structure embodying the invention;

FIG. 2 is an enlarged, fragmentary sectional view taken along line 2—2 of FIG. 1;

FIG. 3 is an enlarged fragmentary sectional view taken along line 3—3 of FIG. 1;

DESCRIPTION OF THE PREFERRED EMBODIMENT

Figure 4:
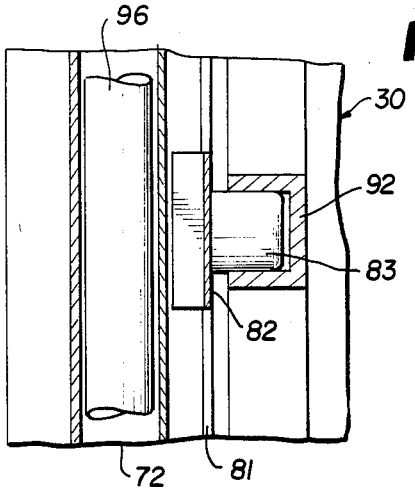
FIG. 4 is a sectional view taken along line 4—4 of FIG. 3.
Figure 5:
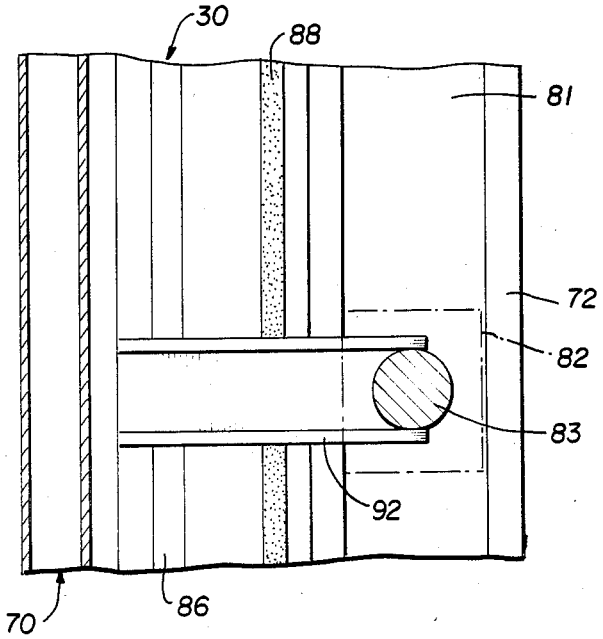
FIG. 5 is a sectional view taken along line 5—5 of FIG. 3.

Referring now to the drawings in detail, a window structure embodying the present invention and adapted to be mounted in a window opening in the exterior wall of a building is illustrated in FIG. 1 and designated generally by the reference numeral 2. While the invention may also be embodied in horizontally moving window structures and doors such as patio doors, it is particularly well adapted for vertically moving windows and will accordingly be described herein with reference to such window structure, it being understood that the invention is not so limited but applies equally to horizontally moving multiple panel closure structures.

Window 12 includes a frame structure indicated generally at 4 and having opposed vertically extending jamb assemblies 6, 8, a header 10 and a sill 12, with the jambs, header and sill being rigidly joined at their end portions to provide a rectangular frame structure adapted to be mounted in an opening in an exterior wall of a building. An extruded aluminum mullion 13 extends transversely of the frame and has its end portions joined to jambs 6, 8 at approximately their midpoints as described more fully hereinbelow. Jambs 6 and 8 are substantially identical and arranged in mirror image of one another, and header 10 and sill 12 may also be constructed of like structural elements.

A pair of rectangular panel members, or sashes 14, 16 are mounted in the frame 4 to close the building opening, with the sashes 14, 16 being relatively movable as described hereinbelow for opening and closing the window. Sashes 14, 16 are substantially identical and each comprise a rigid rectangular frame defined by top and bottom horizontal frame assemblies 18, 20 and opposed side frame assemblies 22, 24 supporting a glazing panel 25.

As shown in FIG. 2, header 10 and sill 12 are each assembled from a plurality of components including a pair of elongated extruded aluminum structural members 26, 28 assembled together by a connector element 30 formed from a thermally insulating material which acts as a barrier preventing the transfer of heat by conduction between aluminum extrusions 26, 28. A plate assembly made up of a pair of extruded angle members 32, 34, retained in assembled relation by a connector strip 36 formed of thermally insulating material, may be provided on the top of header 10.

Extruded structural members 26, 28 are of complex cross sectional shape and cooperate, in their assembled relation, to define a recess 38, the recess 38 in the header being adapted to receive the top frame assembly 18 of upper sash 14 and the space 38 in the sill being adapted to receive the bottom frame assembly 20 of the lower sash 16. Members 28 are each formed with a retaining channel 40 receiving an elongated brush type seal element 42 in position to engage the inner surface of the associated frame member to provide an air seal. Similarly, structural members 26 are formed with a C-shaped retaining channel which receives and supports an elongated resilient sealing strip 46 in position to engage and form a weather seal with the outer surface of the sash frames. Seals 46 are supported on an inwardly opposite leg portion 48, with leg 48 and an inwardly directed arm portion 50 cooperating to define an angular seat for receiving and supporting a conventional window screen assembly indicated generally at 52.

Upper and lower sash frame assemblies 18 and 20 of upper sash 14 are substantially identical and as seen in FIG. 2, each consists of inner and outer extruded aluminum structural members 54, 56, respectively retained in assembled relation by an elongated connector element 58. Connector element 58 is formed from a thermally insulating material to act as a barrier against the transfer of heat between members 54 and 56 by conduction. Spacer members 60 may be provided between members 54, 56 outboard of the connector element 58 to provide rigidity to the frame assembly. Frame members 54 and 56 respectively include parallel flange portions 62, 64, respectively for engaging a resilient glazing strip 66 to support the double glazed glass panel assembly 25.

The upper and lower sash frame assemblies of lower sash 16 are substantially identical to those just described except for an upwardly directed sealing flange 67 on the outer extrusion 56A of the top assembly 18 on the lower sash 16. Flange 67 includes a C-shaped channel 68 which receives and supports a resilient sealing strip 69 for engaging and forming an air seal with the outer surface of extrusion 56 on the bottom frame assembly 20 of upper sash 14 when the two sashes are in the closed position shown in FIG. 2.

Frame jambs 6 and 8 are substantially identical mirror images of one another and accordingly only jamb 6 is shown in FIG. 3. Similarly, sash side frame members 22, 24 are substantially identical for both the top and bottom sashes and accordingly only side frame member 22 of bottom sash 16 is shown in FIG. 3, with minor differences between the bottom and top sash elements being described hereinbelow. Thus, jamb 6 comprises a pair of extruded aluminum shapes 70, 72 retained in assembled relation by a thermally insulating connector strip 74. A flange 76 on extrusion member 70 cooperates with a flange 78 on extrusion member 72 to define an inwardly directed track or channel 79 (FIGS. 7–10) for receiving releasable guide pins or keeper assemblies 80 (FIG. 1) projecting laterally from frame assemblies 22, 24 (the side frames 30, 32) of the upper sash to support and guide the sash 14 for vertical sliding movement along the channels or guide tracks.

A second guide channel or track 81 is formed in the inwardly directed surface of extrusion member 72 and supports a guide block 82 for vertical sliding movement along jamb 6. An inwardly projecting pin 83 is mounted on and carried by guide block 82 to support lower sash 16 in a manner described more fully hereinbelow.

Sash side frame assembly 22 also includes a pair of aluminum extrusions 84, 85 retained in assembled relation by a thermally insulating connector element 86. Extrusion members 84 and 85 also extend in overlapping relation to the glazing support strip 66 to support and retain the double glazed panel 25 as described above with reference to member 54 and 56. A brush-type insulating strip 88 carried on extrusion member 85 forms an air seal with the flange member 78 of extrusion 72, and a second seal member 90 carried on jamb extrusion member 70 forms a weather-tight seal with sash frame member 84 with the seals 88, 90 forming a double seal effectively preventing the passage of air into or out of a building around the edges of sashes 14 and 16.

A pair of short channel members 92, 94 are rigidly mounted on and project inwardly relative to a building opening from the side frame members 22 and 24 of the lower or inner sash 16, with channels 92, 94 being located near the bottom of sash frame member 22, 24, respectively as best seen in FIGS. 1 and 6–10. Guide pins 83 carried by guide blocks 82 project one into the open face of each channel to support sash 16 for vertical sliding movement along track 81 as described in the above-mentioned Pat. No. 4,324,072. Suitable counterbalance means such as the weights 96 shown in FIG. 3 may be connected, through suitable support cords and pulleys, not shown, to the slider blocks 82 to counterbalance the weight of the lower sash 16, and similar counterbalance means may be provided for the upper sash 14 also as described in U.S. Pat. No. 4,324,072.

When the window is closed as shown in FIGS. 1 and 2, the two sash assemblies are disposed in a common vertical plane with seal elements 42 and 46 providing a double seal with the lower sash frame assembly 20 as shown in FIG. 2. In this position, a double seal is also provided along the vertical sides of both sash assemblies by the seal elements 88 and 90, and a double seal is provided at the top of sash 14 by the seal elements 42 and 46. Seal element 69 also forms a weather-tight seal between the two sashes at their contiguous edge portions, again as best seen in FIG. 2.

Referring still to FIG. 2, it is seen that mullion 13 has its outer vertical face surface substantially coplanar with the outer surfaces of jambs 6 and 8, and is mounted on the jambs in position dividing the frame opening into two substantially equally sized rectangular openings, and overlapping the bottom frame assembly 20 of upper sash 14 and the upper frame assembly 18 of lower sash 16 when the window is closed. In vertical cross section, the mullion 13 has a shallow channel-shaped central portion defined by a generally flat central web 98 and upper and lower inwardly directed flanges 100, 102, respectively. An upwardly extending arm 104 integrally formed on the inner edge portion of flange 100 terminates in an inwardly open generally C-shaped seal retaining channel 106 supporting an elongated resilient seal element 108 adapted to engage and form a weather-tight seal with the outer surface of the lower frame assembly 20 of upper sash 14. A similar leg member 110 is integrally formed on and extends downwardly from the edge of flange 102 and terminates in an inwardly directed C-shaped channel 112 which supports a resilient weather-tight seal element 114 for engaging the outer surface of the top frame assembly 18 of lower sash 16. Thus, in the closed position, seal elements 108 and 112 cooperate with seal element 69 to form a double seal of the space between the sashes 14 and 16.

A locking or keeper flange 116 is integrally formed on flange 100 and projects downwardly into the channel portion of mullion 13. Keeper flange 116 has a downwardly and inwardly inclined camming surface 118 adjacent its free edge in position to engage and cooperate with free end portion 120 of an L-shaped locking bar 122 of a security latching mechanism 124. The L-shaped locking bar 122 includes a shaft portion 126 journalled in opposed openings in extrusion members 54, 56A of upper frame member 18 of lower sash 16, and a manually operable handle 128 fixed on the inwardly projecting end of shaft 126 enables rotation of the shaft about its axis to engage and disengage the free end 120 with locking flange 116. A collar 130 fixed on shaft 126 prevents withdrawal of the shaft. A coil spring 132 surrounds a portion of shaft 126 and has one end bearing against a pin 134 extending through the shaft and its other end bearing against a movable collar 136 which, in turn, bears against a bushing 138 in contact with an inwardly directed surface of extrusion 54 to permit limited spring resisted movement of the locking bar 122 outward relative to sash 16 upon rotation of the shaft in engagement with cam surface 118 to lock the window. This maintains a tight seal between the lower sash and the seal element 114. At the same time, upwardly extending flange 67 and seal 69 bearing against the inner surface of extrusion 56 at the bottom of sash 14 urges sash 14 into tight sealing engagement with seal 106 while seal 69 maintains a second air tight seal between the two sash elements. By forming the keeper flange 116 as an integral part of the extruded aluminum mullion 13, the mullion is strengthened and greater rigidity and stability is provided for the window assembly. Further, since the latching engagement between free end 120 of locking bar 122 and the flange 116 is recessed within the mullion, release of the latching mechanism from the exterior of the building is rendered extremely difficult, if not impossible.

Figure 6:
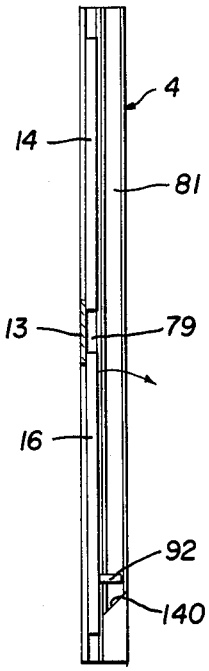
FIGS. 6–10 are schematic side elevation views showing the window structure in various positions.
Figure 7:
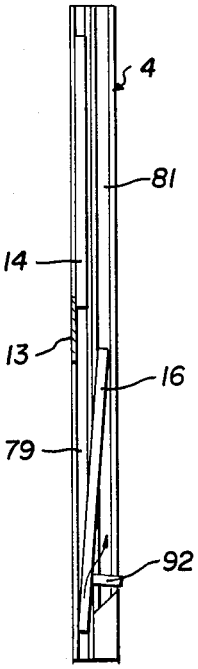
Figure 8:
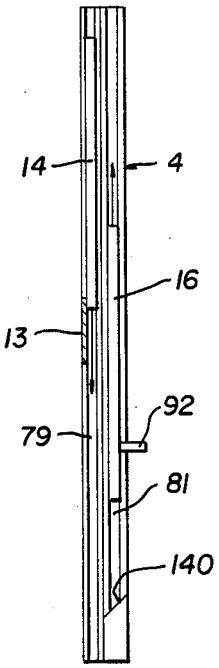

To open the window just described, handle 128 is manually rotated to release the security lock, and the releasable keepers 80 are manually released to permit the top of the lower sash 16 to be pivoted inward to engage the keepers with the outer track 81 as illustrated in FIGS. 6 and 7 of the drawings. Handle 128 is then grasped and pulled upward, sliding the keepers along the track 81. As the lower sash moves upward, the lower edge is free to swing outward with the channels 92, 94 sliding along support pins 83 as guide block 82 is moved upward in track 81 by the lower sash. Once the lower sash is moved inward and secured in the inner track 81, top sash 14 can be manually lowered as indicated in FIG. 8 of the drawings. Thus, the window can be opened from the top and bottom simultaneously in the manner of a conventional double hung window with the outer surface of the upper sash moving closely adjacent mullion 13 and with seals 108 and 114 in sliding contact with the outer surface of side frame element 84.

Figure 9:
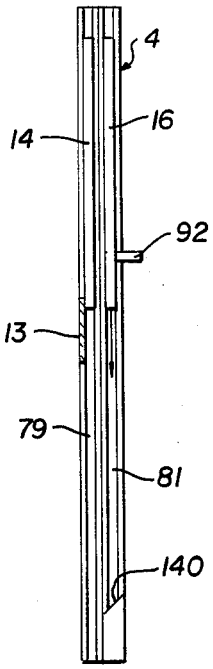
Figure 10:
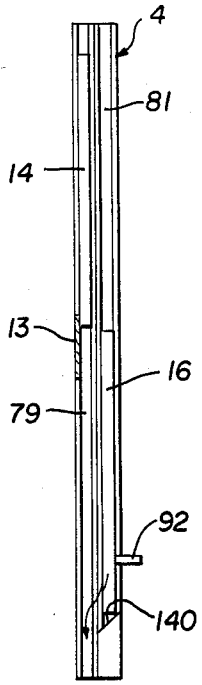

When it is desired to close the window, upper sash 14 is moved to the fully raised position as shown in FIG. 9 and handle 128 is grasped and moved downward until the bottom edge portion of lower sash 16 engages a camming surface 140 on a triangular cam block 142 mounted on the sill 12 as shown in FIG. 10. Further downward movement of the lower sash results in the lower edge of the sash being cammed inward with the channel members 92, 94 sliding freely along pins 83 so that the lower sash can be completely lowered to the position shown in FIG. 7. Thereafter, keepers 80 are released from track 81 and the top of the lower sash is pushed outward into the closed position of FIG. 6 where the keepers then engage track 80. If desired, the security lock can then be manually actuated to securely lock the window structure. The rigid frame structure provided by the mullion 13, in cooperation with the security latching mechanism, provides a more positive weather-tight seal while providing stronger structure which is highly resistant to opening from the exterior of the building.

While a preferred embodiment of the invention has been disclosed and described, it should be apparent that the invention is not so limited and it is therefore intended to include all embodiments which would be apparent to one skilled in the art and which come within the spirit and scope of the invention.

What is claimed is:

1. A door or a window structure for installation in an opening in an exterior wall of a building, comprising an outer frame defining a rectangular opening, said frame including a pair of spaced parallel side frame members and a pair of spaced opposed end frame members, said side and end frame members being rigidly joined to define said rectangular opening, a mullion extending between and having its ends rigidly joined one to each said side frame member at a point substantially equally spaced from each said end frame member, said mullion being disposed adjacent the outer surface of said frame when the frame is installed in an opening in the exterior wall of a building, a pair of outer tracks extending one along each said side frame member in parallel opposed relation to one another, a pair of inner tracks extending one along each said side frame member in parallel opposed relation to one another, a first substantially rectangular panel mounted for sliding movement along said pair of outer tracks from a closed position adjacent one of said end frame members to an open position spaced from said one end frame member, a second substantially rectangular panel, mounting means supporting said second panel for sliding along said pair of inner tracks from a closed position adjacent the other said end frame member to an open position spaced from said other end frame member, said mounting means including means supporting said second panel in substantially edge to edge coplanar relation with said first panel in said closed position and manually operable means to support said second panel in laterally spaced parallel relation to said first panel in the open position, said mullion being spaced outwardly from and overlying adjacent edge portions of said first and second panels when said first and second panels are in said closed position, locking means operable to releasably lock said first and second panels in said closed position, and first seal means forming a weather-tight seal between said mullion and said first and said second panels when said first and second panels are in the closed position.

2. The door or window structure defined in claim 1 further comprising second seal means carried by one of said panels in position to engage the other panel member when said panels are in the closed position.

3. The door or window structure defined in claim 2 wherein said first seal means includes a first and continuously engaging an outer surface of said first panel mounted for sliding movement along said outer tracks.

4. The door or window structure defined in claim 1 wherein said mullion comprises an elongated extruded structural member including a substantially flat web and a pair of integrally formed flanges extending one from each side edge of said web in opposed relation to one another to define an open channel, said open channel being directed toward said panel members, and wherein said locking means includes keeper means located within said open channel.

5. The door or window structure defined in claim 4 wherein said mullion further comprises a pair of leg members integrally formed one on and projecting outwardly from each said flange, said legs extending in outwardly spaced relation to said panel members when said panel members are in said closed position, and wherein said first seal means comprises a resilient seal member mounted on each said leg in position to engage an outwardly directed surface of each said panel member when the panel members are in the closed position.

6. The door or window structure defined in claim 4 wherein said keeper means comprises a keeper flange integrally formed with and extending substantially the full length of said mullion, said keeper flange terminating in a free edge disposed within said channel in position to be engaged by a cooperating latching member carried by said second panel to retain the panels in said closed position.

7. The door or window structure defined in claim 4 further comprising second seal means carried by one of said panel members in position to engage the other said first and second panels when said panel members are in the closed position.

8. The door or window structure defined in claim 7 wherein said first seal means includes a first elongated resilient sealing member carried by said mullion and continuously engaging an outer surface of said first panel member.

9. The door or window structure defined in claim 8 wherein said mullion further comprises a pair of leg members integrally formed one on and projecting outwardly from each said flange, said legs extending in outwardly spaced relation to said first and second panels when said panels are in said closed position, and wherein said first seal means comprises a resilient seal member mounted on each said leg in position to engage an outwardly directed surface of each said panel in the closed position.

10. The door or window structure defined in claim 12 wherein said keeper means comprises a keeper flange integrally formed with and extending substantially the full length of said mullion, said keeper flange terminating in a free edge disposed within said channel in position to be engaged by cooperating latching means on said security lock to retain the panels in said closed position.

11. The door or window structure defined in claim 3 wherein said locking means includes keeper means carried by said mullion and manually actuated latching means carried by said second panel, said latching means being operable to releasably engage said keeper means to releasably lock said first and second panel members in said closed position.

12. The door or window structure defined in claim 11 wherein said first seal means comprises a second elongated sealing member carried by said mullion in position to engage an outer surface of said second panel to form a seal therewith when said second panel is in the closed position.

13. The door or window structure defined in claim 10 wherein said mullion comprises an elongated extruded aluminum structural member including a substantially flat web and a pair of integrally formed flanges extending one from each side edge of said web in opposed relation to one another to define an open channel, said open channel being directed toward said panel members, and wherein said keeper means is integrally formed with said mullion and is located within said open channel.

* * * * *

UNITED STATES PATENT AND TRADEMARK OFFICE

CERTIFICATE OF CORRECTION

PATENT NO. 4,570,381

DATED Feb. 18, 1986

INVENTOR(S) Maurice E. Sterner, Jr.

It is certified that error appears in the above-identified patent and that said Letters Patent are hereby corrected as shown below:

Column 2, line 17, change "referehces" to --references--.

Column 8, Claim 3, line 14, after "first" (second occurrence), insert --elongated resilient sealing member carried by said mullion--.

Column 8, Claim 7, line 46, after "said" (second occurrence), insert --panel member when said--.

Column 8, Claim 7, line 47, delete "when said panel members".

Signed and Sealed this

*Third* Day of *June 1986*

[SEAL]

*Attest:*

DONALD J. QUIGG

*Attesting Officer*

*Commissioner of Patents and Trademarks*